United States Patent [19]

Leblanc

[11] 4,213,700

[45] Jul. 22, 1980

[54] FIRE CONTROL DEVICE

[75] Inventor: Michèle Leblanc, Orsay, France

[73] Assignee: Societe d'Optique Precision Electronique et Mecanique Sopelem, Paris, France

[21] Appl. No.: 971,903

[22] Filed: Dec. 19, 1978

[30] Foreign Application Priority Data

Jan. 6, 1978 [FR] France ..... 78 00275

[51] Int. Cl.[2] ..... G02B 23/10

[52] U.S. Cl. ..... 356/73; 356/252

[58] Field of Search ..... 356/73, 251, 252

[56] References Cited

U.S. PATENT DOCUMENTS 3,464,770 9/1969 Schmidt ..... 356/252

*Primary Examiner*—Vincent P. McGraw

*Attorney, Agent, or Firm*—Haseltine, Lake & Waters

[57] ABSTRACT

A fire control device for sighting a gun by introducing, between the axis of the gun and the direction of the target, an angular shift based on the trajectory of the ammunition, the device comprises a sighting telescope in which an image of fire crosswires defining a line of collimation are visible and means for moving the fire crosswires in dependance on a signal from a rangefinder of the laser type which includes a first collimator comprising an objective and crosswires for sighting the rangefinder and an image of which can be seen in the telescope, and a second collimator for shifting the line of collimation which comprises an objective and the fire crosswires which are placed at the focal point of the objective, the second collimator being associated with an optical reflecting element for reflecting the image of the fire crosswires into the telescope and the two collimators are arranged so that the image of the sighting crosswires passes through the optical reflecting element and is reflected by the fire crosswires towards the optical reflecting element, the fire crosswires being provided with a reflecting face for this purpose.

6 Claims, 1 Drawing Figure

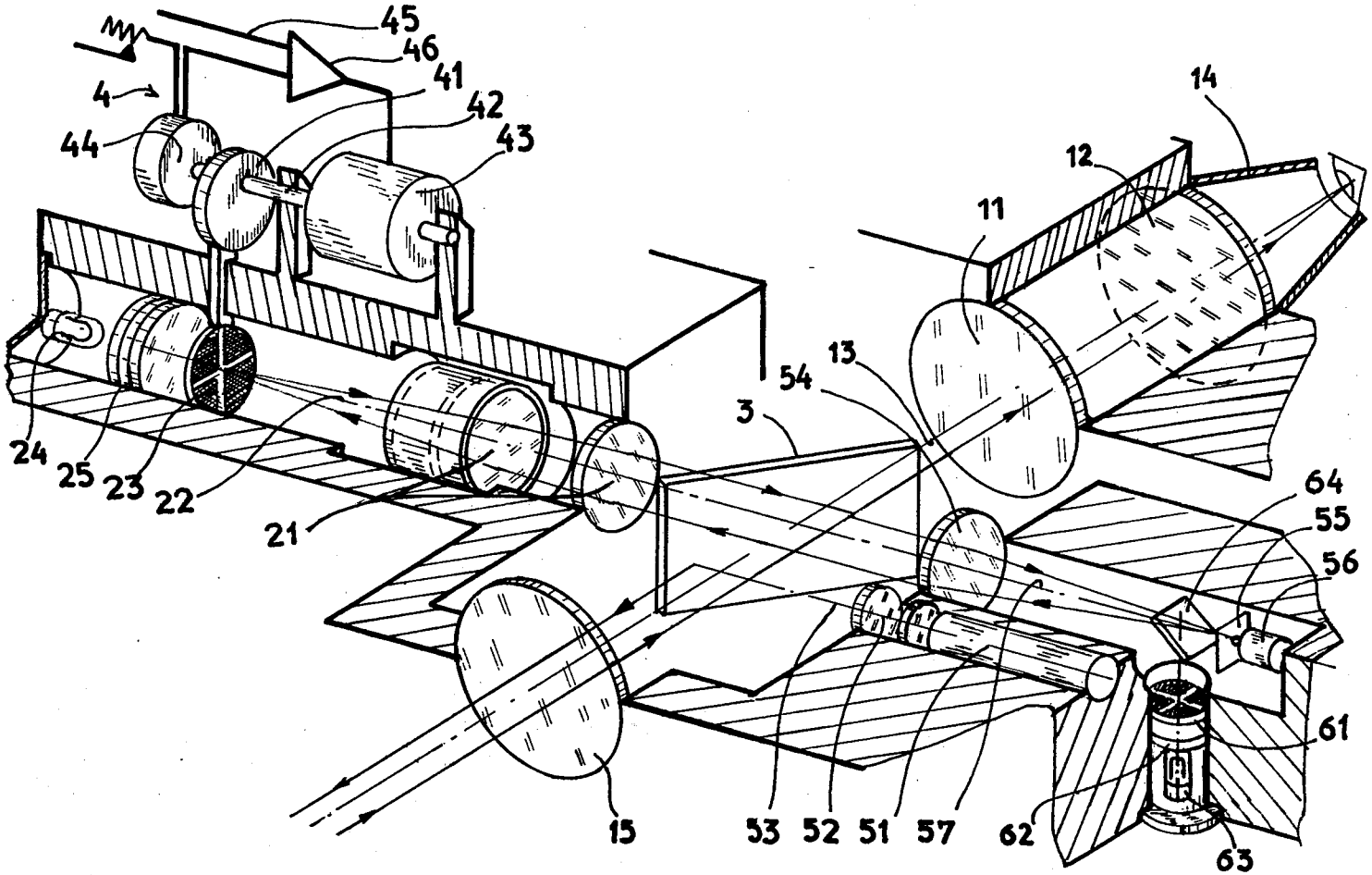
14
12
11
13
54
3
64
55
56
61
63
62
57
51
52
53
15
21
22
23
25
24
43
42
41
46
45
44
4

FIRE CONTROL DEVICE

The present invention relates to a fire control device for sighting a gun by introducing, between the axis of the gun and the direction of the target, an angular shift based on the trajectory of the ammunition, and is particularly but not exclusively for use in an artillery vehicle.

A gun of an artillery vehicle can pivot relative to the vehicle about two axes which are perpendicular. The gun is mounted on a turret so that it can pivot about substantially vertical axis. Furthermore, the gun generally pivots, relative to the turret, about an axis which is substantially perpendicular to the axis of rotation of this turret.

The direction of sighting of the gun, relative to the direction of the target, takes into account certain parameters which will be mentioned below. Because the gun is a long way from the target and the ammunition describes a curve in space, it is necessary to provide a so-called angle of elevation between the direction of the gun and the direction of the target. The relationship between the angle of elevation and the range is not linear. When the vehicle carrying the gun is inclined so that the pivoting axis of the gun is not horizontal, the inclination of the pivoting axis must be taken into account in order to correct the angle of elevation accordingly. Other parameters are also important. The angle of sight must be corrected in order to take account, in particular, of the angle of elevation, this correction depending on the range. The lateral deflection must also be corrected in order to take account of certain parameters, and this correction is very approximately proportional to the angle of elevation.

Various fire control devices are known. Reference may be made, for example, to U.S. Pat. No. 2,887,774, French Pat. No. 2,016,096 and French Pat. No. 2,140,699.

A fire control device comprises a fire telescope, which may be a periscopic telescope or a shielded telescope. Crosswires are visible in the telescope in order to define a line of collimation. At the start of the operation, the line of collimation is sighted on the target, the gun being parallel to this line. An angular shift in the line of collimation is effected and this line is again sighted on the target. The angular shift takes account of the various fire parameters.

The line of collimation is shifted by at least one optical element which is incorporated in the telescope and subjected to a drive mechanism. The shift can be achieved either by moving the crosswires, as in U.S. Pat. No. 2,887,774, or by manoeuvring a diasporameter, as in French Pat. No. 2,140,699, or by moving a mirror, as in French Pat. No. 2,016,096.

Determination of the amplitude of the shift requires a rangefinder. This instrument measures the range of the target and makes it possible to determine the appropriate values of the corrections to be made, to control a motor or motors which manoeuvre the optical element or elements shifting the line of collimation.

The rangefinder measurement is converted into one or two signals which correspond to the corrections to be made, these signals acting on the motors for manoeuvring the optical elements which deflect the line of collimation. This conversion is carried out either by an electronic calculator which receives the signal from the rangefinder and, if appropriate, the signals from other sensors, or by a cam mechanism.

The rangefinders which are in current use are laser rangefinders.

In certain fire control devices using a laser rangefinder, it is desired to keep the rangefinding direction parallel to the direction of the line of collimation. The rangefinding direction is sighted on the target, even if the sighting correction has been made, and the direction is then shifted relative to the axis of the gun. In other fire control devices, the rangefinding direction remains fixed relative to the gun, regardless of the position of the line of collimation. If the line of collimation has been shifted, it is difficult to determine the rangefinding direction with accuracy.

The present invention relates to a fire control device which is such that the rangefinding direction constantly remains parallel to the gun, whilst being located in the field of vision of the telescope. The line of range finding is located by the projection, into the fire telescope, of crosswires which are independent of the movable crosswires defining the sighting direction. The design of the device is simple and uses a minimum number of optical elements.

It is an object of the invention to provide a fire control device for sighting a gun by introducing, between the axis of the gun and the direction of the target, an angular shift based on the trajectory of the ammunition, said device comprising:

fire crosswires;

a sighting telescope for providing an image of said fire crosswires defining a line of collimation;

a rangefinder of the laser type comprising means for emitting a laser beam, means for receiving said beam after scattering, and means for producing a signal indicating the range;

means for moving said fire crosswires in dependence on said signal from said rangefinder;

a first collimator forming part of said rangefinder and comprising an objective, sighting crosswires for sighting said rangefinder, and means for producing an image of said sighting crosswires visible through said telescope for locating the direction of measurement of the range;

a second collimator for shifting said line of collimation comprising an objective and said fire crosswires which are placed at the focal point of said objective;

an optical reflecting element associated with said second collimator for reflecting the image of said fire crosswires into said telescope; and second first collimator and said second collimator being arranged so that the image of said sighting crosswires passes through said optical reflecting element and is reflected by said fire crosswires towards said optical reflecting element, said fire crosswires being provided with a reflecting face for reflecting said image of said sighting crosswires.

Preferably said fire crosswires comprises a plate which is provided with transparent intersecting lines, against an opaque background, and with said reflecting face. The optical reflecting element may comprise a semi-reflecting face which is positioned so that said fire crosswires and the eyepiece of said telescope are located on the same side of said semi-reflecting surface, said first collimator and said second collimator may be arranged one on each side of said optical reflecting element.

The invention will now be described in greater detail with reference to an embodiment thereof which is given by way of example only, and illustrated in the accompanying drawing.

In the drawing:

The single FIGURE is a perspective view with parts cut away, of an embodiment of a fire control device according to the invention.

As shown in the drawing the device is placed in front of a sighting telescope which comprises a system of lenses comprising an objective 11 and an eye-piece 12. These lenses are aligned along with an optical axis 13 which is parallel to the axis of the gun, the latter not being shown. The eyepiece 12 is associated with a shade 14.

The image of fire crosswires defining the line of collimation can be seen in the telescope. This image comes from a collimator comprising an objective 21 and crosswires 23. As is customary, the crosswires 23 are placed at the focal point of the objective 21 so as to produce an image at infinity. The crosswires are illuminated by a source of light 24 associated with an optical system 25. The collimator formed by the objective 21 and the crosswires 23 is arranged, relative to the telescope, so that its optical axis 22 intersects the optical axis 13 of the telescope. The two axes are preferably at 90° to one another.

The image of the fire crosswires is reflected in the field of the telescope by an optical reflecting element 3. The line of collimation passes through the image of the intersection of the lines of the fire crosswires 23. The optical reflecting element 3 possesses a semi-reflecting plane face which can reflect the image of the fire crosswires 23, whilst allowing the image of the landscape to pass through. The optical reflecting element 3 is placed in front of the objective of the telescope so as to reflect the image at infinity of the fire crosswires. The semi-reflecting face is positioned so that the fire crosswires, on the one hand, and the eyepiece of the telescope, on the other hand, are located on the same side of this face. Furthermore, it is positioned at the point of intersection of the axes 13 and 22 and is perpendicular to the bisector of the angle formed by these axes. Because the angle formed between the optical axes 13 and 22 is a right-angle, the semi-reflecting face is at 45° to these axes. The optical reflecting element provided with the semi-reflecting face consists of either a plane mirror or a separating cube.

A control mechanism 4 uses a signal provided by a laser rangefinder of the fire control device to move the fire crosswires 23, so as to introduce a shift in the angle of sight of the line of collimation, and this makes it possible to take into account certain parameters such as the elevation. The mechanism for controlling the crosswires may comprise a calculator which is set to calculate the correction to be made to the line of collimation, using the signals from sensors and from the laser rangefinder. In the embodiment shown in the drawing, the crosswires are moved by a cam 41, the profile of which is determined by the values of elevation of the firing table. The cam rotates about an axis 42 and is driven by a motor 43. The position of the cam is registered by a coder 44. The signal provided by the laser rangefinder is transmitted to the servo-control which governs the motor. Thus, the signal from the rangefinder is transmitted, along line 45, to an additive amplifier 46 which controls the motor 43 and receives the signal from the coder.

The laser rangefinder comprises an emission unit which comprises a laser 51 associated with an optical system 52, having an optical axis 53. Since the emission unit is not parallel to the telescope, the beam is reflected by the optical reflecting element 3. The rangefinder moreover comprises a receiving unit formed by an optical system 54, a diaphragm 55 and a photoelectric cell 56. As is customary, the rangefinder comprises a counter which is not shown in the FIGURE. This counter produces a signal which is a function of the time which elapses between the emission and the reception of the beam of light from the laser.

The laser rangefinder comprises a sighting collimator which consists of the objective 54, serving to focus the back-scattered laser beam, and crosswires 61 for the sighting and locating operations of the rangefinder. These crosswires are illuminated by a source of light 63 associated with an optical system 62.

Because the back-scattered laser beam and the beam coming from the crosswires 61 are refracted by the objective 54, an optical separating element 64 is used to separate the beam passing from the crosswires 61 to the objective 54 from the laser beam which is focused by the objective 54. This optical element 64 consists, for example, of a dichroic plate. In the embodiment shown in the FIGURE, it is the beam coming from the crosswires 61 which is reflected by the plate 64.

The collimator for sighting the rangefinder, which comprises the objective 54 and the crosswires 61, and the collimator for shifting the sighting, which consists of the objective 21 and the crosswires 23, are arranged on either side of the semi-reflecting face of the plate 3. The optical axis 57 of the objective 54 and the optical axis 22 of the objective 21 are aligned. The plane semi-reflecting face of the plate 3 is positioned at the point of intersection of the optical axis 57 and the optical axis 13 of the telescope, along the bisector of the angle formed by these axes. The axis 57 is preferably perpendicular to the optical axis 13.

The collimator for shifting the line of sighting, which comprises the fire crosswires 23, is mechanically integral with the laser rangefinder and, in particular, with the collimator for sighting the rangefinder. The unit is mounted in front of the telescope. A window 15, which is placed in front of the telescope and in front of the optical reflecting element 3, protects this unit.

Having emerged from the objective 21, the beam of light from the fire crosswires 23 is reflected on the plate 3. The image of the fire crosswires is thus projected into the field of the telescope.

The plate 3 also serves to reflect the incident laser beam directed towards the target and the back-scattered laser beam coming from the target.

The beam of light coming from the crosswires 61 is reflected by the plate 64 and is then refracted in order to give an image at infinity. The beam of light passes through the optical reflecting element 3 and is focused by the objective 21 onto the fire crosswires 23. The beam of light is reflected on the fire crosswires 23 and is again refracted by the objective 21. The beam emerges from this objective to give an image at infinity of the crosswires for sighting the rangefinder. The beam is reflected on the optical reflecting element 3 so that the image of the crosswires 61 is seen in the telescope.

In order to ensure the reflection of the beam from the crosswires 61 of the rangefinder, the fire crosswires 23 consist of a plate provided with transparent intersecting lines which stand out against an opaque background.

These crosswires are provided with a reflecting face, on the side where the objective 21 is located, so as to produce a mirror. The layer forming the reflecting face can constitute the opaque background. The crosswires 61 for sighting the rangefinder can consist of transparent lines on an opaque background or of dark lines on a light background.

The beam produced by the corosswires 61, over the distance between the plate 3 and the objective 21, and the corresponding reflected beam, over the distance between the objective 21 and the said plate, are parallel. Furthermore, they are parallel to the optical axis 57. This particular characteristic is due to the fact that the catadioptric system formed by the objective 21 and by the mirror of the crosswires 23, placed at the focal point of the objective, constitutes an invariant optical system. The reflected beam arriving on the plate 3 has a constant position relative to the optical axis of the telescope, and the image of the rangefinder crosswires is therefore fixed in the field of the telescope.

The fire crosswires 23 can be moved by the associated mechanism 4. The image of the fire crosswires can thus move in the field of the telescope. The movement of the fire crosswires does not affect the path of the rays coming from the rangefinder crosswires. Even if the crosswires are not exactly perpendicular to the optical axis of the objective 21, the path of the rays is not altered.

Of course it is possible to envisage variants and improvements in detail, and also to envisage the use of equivalent means, without going outside the scope of the invention.

What is claimed is:

1. A fire control device for sighting a gun by introducing, between the axis of the gun and the direction of the target, an angular shift based on the trajecotry of the ammunition, said device comprising:

fire crosswires;

a sighting telescope for providing an image of said fire crosswires defining a line of collimation;

a range finder of the laser type comprising means for emitting a laser beam, means for receiving said beam after scattering, and means for producing a signal indicating the range;

means for moving said fire crosswires in dependance on said signal from said rangfinder;

a first collimator forming part of said rangefinder and comprising an objective, sighting crosswires for sighting said rangefinder, and means for producing an image of said sighting crosswires visible through said telescope for locating the direction of measurement of the range;

a second collimator for shifting said line of collimation comprising an objective and said fire crosswires which are placed at the focal point of said objective;

an optical reflecting element associated with said second collimator for reflecting the image of said fire crosswires into said telescope; and said first collimator and said second collimator being arranged so that the image of said sighting crosswires passes through said optical reflecting element and is reflected by said fire crosswires towards said optical reflecting element, said fire crosswires being provided with a reflecting face for reflecting said image of said sighted crosswires.

2. A fire control device according to claim 1, wherein said fire crosswires comprise a plate which is provided with transparent intersecting lines, on an opaque background, and with said reflecting face.

3. A fire control device according to claims 1 or claim 2 wherein said optical reflecting element comprises a semi-reflecting face which is positioned so that said fire crosswires, and the eyepiece of said telescope are located on the same side of said semi-reflecting face.

4. A fire control device according to claim 3, wherein said first collimator and said second collimator are arranged one on each side of said semi-reflecting face of said optical reflecting element.

5. A fire control device according to claim 4, wherein said first collimator and said second collimator are arranged with their optical axes aligned.

6. A fire control device according to claim 1, comprising an optical separating element for separating the beam passing from said sighting crosswires towards said optical system of the second collimator from the laser beam from said laser beam emitting means which is also focused by said objective.

* * * * *